United States Patent [19]

Salama et al.

[11] Patent Number: 4,990,030

[45] Date of Patent: Feb. 5, 1991

[54] HYBRID COMPOSITE MOORING ELEMENT FOR DEEP WATER OFFSHORE STRUCTURES

[75] Inventors: Mamdouh M. Salama, Ponca City, Okla.; Richard M. Vennett, Oslo, Norway

[73] Assignee: Conoco Inc., Ponca City, Okla.

[21] Appl. No.: 684,779

[22] Filed: Dec. 21, 1984

[51] Int. Cl.[5] ..... E02B 17/00

[52] U.S. Cl. ..... 405/224; 114/265

[58] Field of Search ..... 405/195, 203, 204, 224, 405/227; 175/7; 114/230, 264, 265, 293, 294; 52/223 R

[56] References Cited

U.S. PATENT DOCUMENTS

| | | | |
|---|---|---|---|
| 3,517,517 | 6/1970 | Blenkarn | 175/7 X |
| 3,882,650 | 5/1975 | Gugliotta | 52/223 R |
| 4,226,555 | 10/1980 | Bourne | 405/204 X |
| 4,275,537 | 6/1981 | Pinson | 52/223 R |
| 4,285,615 | 8/1981 | Radd | 405/224 X |
| 4,425,056 | 11/1984 | Hunter | 405/224 |
| 4,468,157 | 8/1984 | Horton | 405/224 |
| 4,516,882 | 5/1985 | Brewer et al. | 405/224 |

*Primary Examiner*—David H. Corbin

[57] ABSTRACT

A lightweight, high modulus mooring element for a tension leg platform comprises a pretensioned composite member in fixed attachment to and surrounded by a metallic tubular member in compression prestress. The hybrid composite assembly offers significant cost and weight savings over an all steel mooring system for use in deep water tension leg platform mooring.

12 Claims, 1 Drawing Sheet

HYBRID COMPOSITE MOORING ELEMENT FOR DEEP WATER OFFSHORE STRUCTURES

This invention relates to the art of floating offshore structures such as tension leg platforms and, more particularly, to a lightweight, hybrid composite structure for use as a mooring element for such offshore structures.

BACKGROUND OF THE INVENTION

With the gradual depletion of subterranean and shallow subsea hydrocarbon reservoirs, the search for additional petroleum reserves is being extended to deeper and deeper waters on the outer continental shelves of the world. As such deeper reservoirs are discovered, increasingly complex and sophisticated production systems have been developed. It is projected that by the year 1990, offshore exploration and production facilities will be required for probing depths of 6,000 feet or more. Since bottom founded structures are generally limited to water depths of no more than about 1,500 feet by current technology and because of the shear size of the structure required, other, so called compliant structures have been developed.

One type of compliant structure receiving considerable attention is a tension leg platform (TLP). A TLP comprises a semisubmersible-type floating platform anchored by piled foundations through vertically oriented members or mooring lines called tension legs. The tension legs are maintained in tension at all times by insuring that the buoyancy of the TLP exceeds its operating weight under all environmental conditions. The TLP is compliantly restrained in the lateral directions allowing sway, surge and yaw while vertical plane movement of heave, pitch and roll are stiffly restrained by the tension legs.

Several aspects of the design of the compliant structure concept are developed from dynamic considerations of the structure due to excitation by water waves. To minimize sway motions, the natural sway period of the structure must be either less than or greater than the wave periods at the various sea states. A stiff structure such as a fixed platform is designed with a natural sway period which is less than the wave period. However, the natural sway period of fixed platforms increases with increasing water depths and ultimately approaches the wave period resulting in large platform motions. In a compliant structure such as a TLP, the natural sway period is designed to be greater than the wave period.

Current TLP designs utilize heavy walled steel tubulars for the mooring elements. These tension legs constitute a significant weight with respect to the floating platform, a weight which must be overcome by the buoyancy of the floating structure. For instance, the tension legs utilized on the first commercial TLP installed in the Hutton Field of the British North Sea in 485 feet of water comprise steel tubulars having an outer diameter of 10.5 inches and an inner bore diameter of 3.0 inches. It should be readily apparent that, with increasingly long mooring elements being required for a tension leg platform in deeper and deeper waters, a floating structure having the necessary buoyancy to overcome the extreme weight of such mooring elements must be so large as to be uneconomic. Further, the handling equipment for installing and retrieving the long, heavy tension legs adds excessive weight and complexity to a tension leg platform system. Floatation systems can be utilized but their reliability is questionable. In addition, they cause an increase in the hydrodynamic forces on the structure.

In an effort to lower the weight of deep water tension legs while retaining the strength of the heavy steel tubulars, it has been proposed that high modulus composite structures 1 of carbon fiber and/or aramid fiber be employed While there is a significant reduction in the weight of such composite tension legs, composite structures are susceptible to impact damage. Furthermore, the relatively high cost of the raw materials renders the use of composites expensive and, thus, uneconomic for any installation other than to produce a large subsea oil bearing structure or in very deep waters.

SUMMARY OF THE INVENTION

The present invention provides a hybrid composite structure for use as a tensioned mooring element in a tension leg platform which is lighter in weight than current heavy-walled steel tubulars but has improved damage resistance and lower cost when compared to fiber reinforced composites.

In accordance with the invention, an assembly for use in a tensioned mooring element for a floating offshore structure comprises a pretensioned body having a plurality of longitudinally oriented fibrous elements in tension prestress. The pretensioned body is in fixed attachment to a surrounding metallic outer tubular member in compression prestress.

Further in accordance with the invention, the above described assembly further includes threaded connectors attached to the metallic tubular member.

Still further in accordance with the invention, a plurality of the above described assemblies are attached in an end to end relationship and connected with a subsea anchor member and a floating platform and placed in tension to provide a tensioned mooring element for such floating platform.

It is therefore an object of this invention to provide a low cost, lightweight mooring element for floating offshore structures.

It is yet another object of this invention to provide a low cost, lightweight mooring element which is protected from impact damage.

It is a further object of this invention to provide a lightweight, low cost mooring element which will permit the extension of tension leg platform technology to deeper waters than are currently economically possible utilizing tensioned mooring elements made solely from steel.

BRIEF DESCRIPTION OF THE DRAWINGS

These and other objects of the invention are accomplished through the manner and form of the present invention to be described hereinafter in the more limited aspects of a preferred embodiment thereof and illustrated in the accompanying drawings forming a part of this specification and in which.

DETAILED DESCRIPTION OF THE PREFERRED EMBODIMENTS AND THE DRAWINGS

Figure 1:
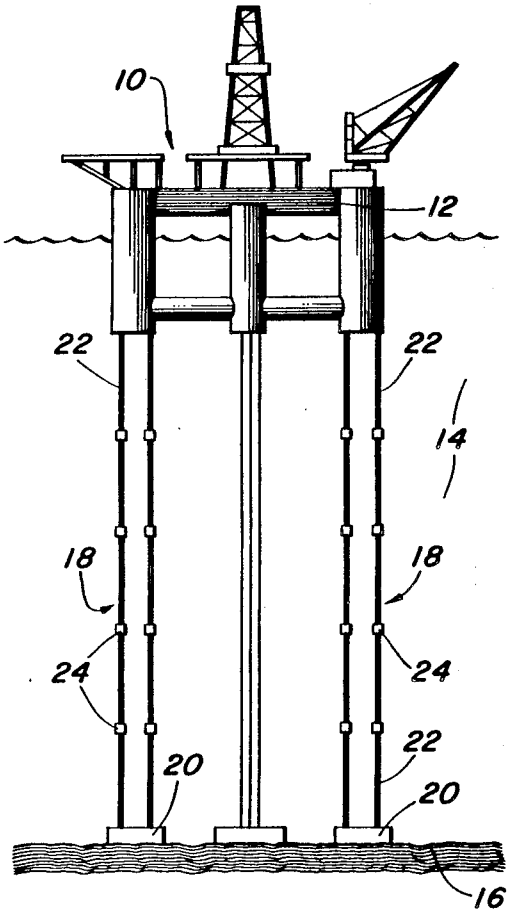
FIG. 1 is a schematic, side elevational view of a tension leg platform in which the hybrid composite mooring elements of the present invention may be incorporated.

Referring now to the drawings wherein several figures are presented for illustrating a preferred embodiment of the invention only and not for the purpose of limiting the scope of the invention, FIG. 1 shoWs an offshore tension leg platform 10. The TLP 10 generally comprises a platform 12 floating on a body of water 14 and which is anchored to the bottom 16 of the body of water by a plurality of tensioned mooring elements 18 which extend between the floating platform 12 and anchoring means 20 which are located on the bottom 16 of the body of water 14. The anchoring means 20 are adapted for connection of a plurality of tensioned mooring elements 18 and are secured in position by a plurality of pilings extending into the bottom 16.

In accordance with a preferred embodiment of the invention, the tensioned mooring elements 18 comprise a plurality of lightweight hybrid composite tubular assemblies 22 which are interconnected at their ends by a plurality of metallic connectors 24. The tensioned mooring elements 18 are maintained in constant tension between the anchoring means 20 and the floating platform 12 by the buoyancy of the floating platform 12 which is constantly maintained in excess of its operating weight under all conditions.

In accordance with the invention, the hybrid composite tubular assemblies 22 of the mooring elements 18 comprise a metallic outer tubular member 26 (FIG. 2) having connector portions welded thereto such as pin 28 and box 30 elements which are threaded for interconnection with other composite tubular assemblies 22. Disposed within the interior 32 of the metallic outer tubular member 26 is a high modulus composite tubular member 34. The high modulus composite tubular 34 is constructed of a high modulus, generally longitudinally oriented fibrous materials in a resin matrix. In a preferred embodiment of the invention, the composite tubular 34 comprises high modulus carbon fibers disposed in an epoxy matrix, the carbon fiber being disposed either longitudinally or in a low-pitch helical wind. Although carbon fibers are preferred, other fibrous materials may be used which either alone or in combination with carbon fibers meet the high modulus of elasticity requirements such as boron fibers, aramid fibers, and the like.

The composite tubular 34 includes a radially-enlarged end portion 36 which, in accordance with the invention, is in compressive engagement against a radially extending land portion 38 of the pin element 28. In a similar manner, the opposite end 40 of the composite tubular 34 comprises a threaded fitting 42 and a threaded nut 44 which is in compressive engagement with a radially extending land portion 46 of the box element 30. The threaded fitting 42 of the composite tubular 34 is preferably made of metal and the fibrous composite materials of the composite tubular 34 are bonded to the fitting 42 by means which are known in the art.

From the above, it can be seen that with the tightening of the nut 44 on the threaded fitting 42 of the composite tubular 34, the composite tubular 34 is placed in tension prestress while the metallic outer tubular member 26 is correspondingly placed in compressive prestress. The tension and compression prestresses are adjustable by means of varying the tightening of the nut 44 against the land 46 of the box element 30.

Figure 3:
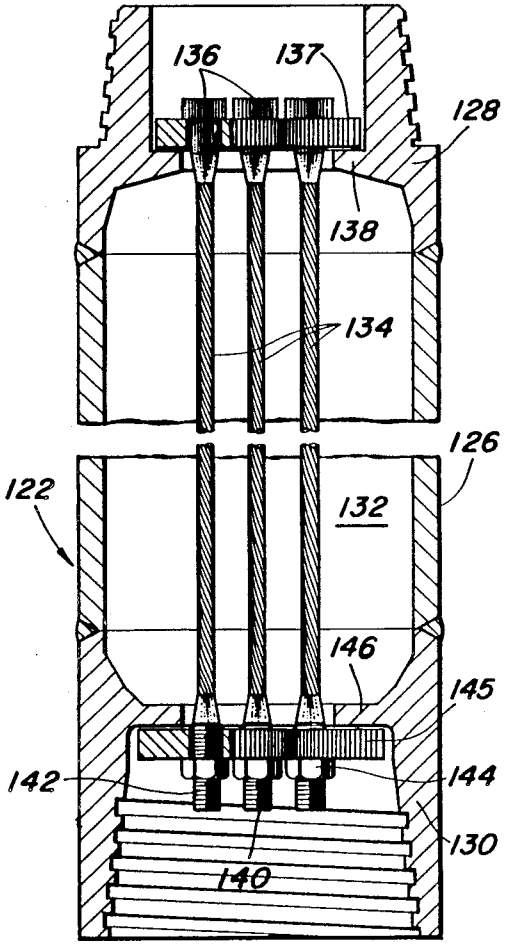
FIG. 3 is a cross sectional view of another form of the present invention.

An alternative form of the invention is shown in FIG. 3. A lightweight composite tubular assembly 122 comprises a metallic outer tubular member 126 which has a pin element 128 and box element 130 welded thereto. In lieu of a high modulus composite tubular such as that indicated by 34 in FIG. 2, a plurality of high modulus composite tendons 134 are provided. The tendons 134 are constructed in a manner similar to the high modulus composite tubular 34, that is utilizing high modulus fibrous materials in a resin matrix. The tendons 134 may comprise parallel lay cable or composite rod of the high modulus fiber. A plurality of tendons 134 may be provided depending on the design requirements of the composite tubular assembly 122 in use.

Figure 2:
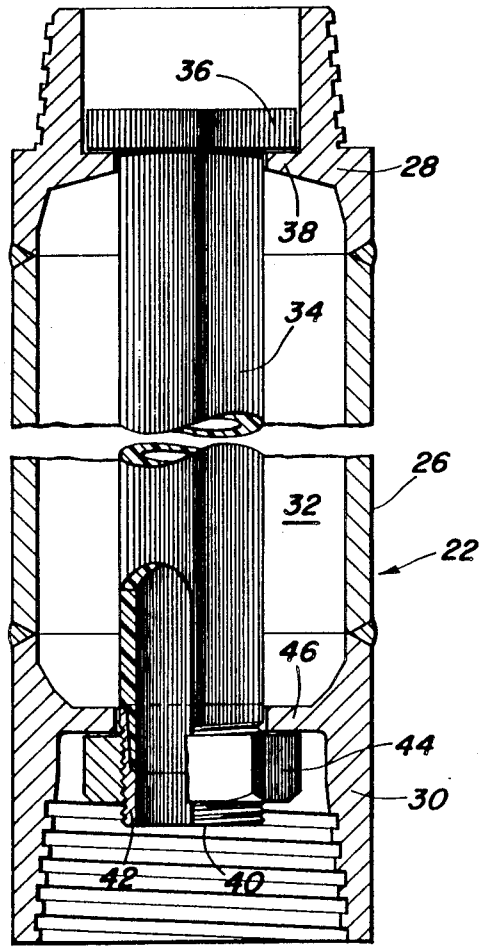
FIG. 2 is a cross sectional view of one form of mooring element assembly, in accordance with the present invention.

In a manner similar to that shown in FIG. 2, each of tendons 134 has an enlarged diameter dead end portion 136 which bears in compressive engagement against a perforated circular plate 137 which in turn bears against a radially inwardly extending land portion 138 of the pin element 128. Further, in a similar manner, the opposite end 140 of each of the tendons 134 includes a threaded end fitting 142 and a nut 144 which bears in compressive engagement against a second perforated circular plate member 145 which further bears in compressive engagement against a radially inwardly extending the land portion 146 of the box element 130. Thus, as with the embodiment shown in FIG. 2, it can be seen that the tension on the high modulus tendons 134 can be varied by the tightening nuts 144 against the circular perforated plate 145 to place the high modulus composite tendons in tension prestress while the metallic outer tubular member 126 is placed in compression preload.

In addition to the use of a plurality of cables which are each provided with end fittings 136, 142, it is also contemplated that the tendons 134 may be comprised of a single length of high modulus composite cable. In this embodiment (not shown) the plato elements 137, 145 includes a curved bearing block or pulley over which the single continuous cable is returned to the opposite end of the composite assembly 122. Thus, a sinuous winding of a single length of cable provides the same effect as the plurality of individual tendons 134 as shown in FIG. 3. Al of the tendons are prestressed by the tightening of a single nut on a threaded end fitting in the manner of the tightening of the nuts 144 on the end fittings 142 (FIG. 3).

This invention allows the use of low cost, welded-on mechanical connectors for simple assembly of a tensioned mooring element. The weld is located in a position which is prestressed in compression and, therefore, is subjected to tensile loads during its service life. In addition, the tensile pretension, particularly for parallel lay cables, will lead to higher elastic modulus, which is desirable.

Should collapse of the metallic outer tubular member 26, 126 be a problem, the interior space 32, 132 can be filled with a lightweight foam to aid in internal stiffening.

The axial stiffness of the hybrid composite tubular of this invention is proportional to the sum of the EA of the metal tubular and the EA of the composite rods wherein E is the elastic modulus of the component material and A is the cross sectional area of the component. The environmental load is distributed in proportion to the respective EA values.

EXAMPLE

For a TLP in 3,000 feet of water utilizing 16 vertically oriented mooring elements, the following design conditions apply for the use of steel tubulars alone:

Maximum load per line $=4.4\times10^6$ lbs $EA=4.0\times10^9$ lbs

Thus, an all steel mooring system requires tubulars with a cross sectional area of 135 square inches (25" 0.D. $\times$ 1 ¾"thickness). The weight in water of a mooring element of this design is 250 pounds per foot.

This compares with a hybrid composite made in accordance with the present invention having an outer steel tubular member of 15 inch diameter and 1/2 inch wall thickness such that:

Cross sectional area of the steel $=24.0$ square inches.

(EA) of the steel equals $0.7\times10^9$ lbs

The steel tubular thus contributes 17.5 percent of the required EA values. The remaing 82.5 percent total EA is provided by a high modulus composite tube or tendon system disposed within the tubular in accordance with the invention wherein the elastic modulus of the composite is 60 $\times$ 106 psi and the cross sectional area of the composite member is 55 square inches giving an EA for the composite of 3.3 $\times$ 109 pounds.

The weight of the total hybrid composite mooring system of this example of the present invention in water is 52 pounds per foot. Thus, there is a 198 pound per foot savings in the weight of the hybrid composite tubulars of this example of the invention over that of an all steel mooring system. The total weight savings for the installation would be 4,300 tonnes. This weight saving can result in a cost saving that exceeds 32 million dollars in a TLP installation in addition to other benefits such as ease at handling, storage, joining and the like for the mooring system due to its smaller size and weight.

If the composite system is prestressed in tension by 5 ksi, the steel tubular is prestressed in compression by 11 ksi, i.e.:

Maximum stress on the steel tubular equals 21 ksi.

Maximum stress on the high modulus composite equals 71 ksi.

These stress levels are well within the capability of both high modulus composite materials and weldable low strength steel tubulars.

While the invention has been described in the more limited aspects of a preferred embodiment thereof, other embodiments have been suggested and still others will occur to those skilled in the art upon the reading and understanding of the foregoing specification. It is intended that all such embodiments be included within the scope of this invention as limited only by the appended claims.

Having thus described our invention, we claim:

1. A tension load-bearing assembly (for use in a tensioned mooring element for a floating offshore structure) comprising a pretensioned body having a first diameter and a plurality of longitudinally oriented nonmetallic fibrous elements in tension prestress, said pretensioned body being in fixed attachment to a surrounding, larger diameter metallic tubular member in compression prestress.

2. The assembly as set forth in claim 1 wherein said fibrous elements comprise a composite tubular member.

3. The assembly as set forth in claim 1 further including threaded connectors attached to said metallic tubular member.

4. The assembly as set forth in claim 3 wherein said fibrous elements are in fixed attachment with said threaded connectors.

5. The assembly as set forth in claim 1 wherein said fibrous elements comprise a plurality of longitudinally disposed composite tendons.

6. The assembly as set forth in claim 5 wherein said tendons comprise high modulus cables.

7. The assembly as set forth in claim 6 wherein said tendons are formed by a sinuous winding of a single length of high modulus cable.

8. The assembly as set forth in claim 6 wherein said high modulus cables have a parallel lay of said fibrous elements.

9. The assembly as set forth in claim 5 wherein said tendons comprise composite rods.

10. The assembly as set forth in claim 1 wherein said fibrous elements comprise carbon fibers.

11. The assembly as set forth in claim 1 wherein said fibrous elements comprise aramid fibers.

12. A mooring element for use as a tension leg in a floating, offshore tension leg platform which comprises a plurality of tension-load bearing interconnected lightweight composite tubular assemblies, each of the assemblies comprising a pretensioned body having a first diameter and a plurality of longitudinally oriented nonmetallic fibrous elements in tension prestress, the pretensioned body being in fixed attachment to a surrounding, larger diameter metallic tubular member in compression prestress.

* * * * *